US008192299B2

(12) United States Patent
Sato et al.

(10) Patent No.: US 8,192,299 B2
(45) **Date of Patent: *Jun. 5, 2012**

(54) GOLF CLUB AND METHOD FOR ADJUSTING PROPERTIES THEREOF

(75) Inventors: Fumiaki Sato, Chichibu (JP); Hiroshi Takahashi, Chichibu (JP); Hideo Matsunaga, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 129 days.

This patent is subject to a terminal disclaimer.

(21) Appl. No.: 12/558,768

(22) Filed: Sep. 14, 2009

(65) Prior Publication Data

US 2010/0144459 A1 Jun. 10, 2010

(30) Foreign Application Priority Data

Dec. 4, 2008 (JP) ..... 2008-309897

(51) Int. Cl.
*A63B 53/02* (2006.01)

(52) U.S. Cl. ..... 473/307; 473/288; 473/246; 473/309

(58) Field of Classification Search ..... 473/288, 473/296, 298–299, 307, 310, 244–248
See application file for complete search history.

(56) References Cited

U.S. PATENT DOCUMENTS

| | | | | |
|---|---|---|---|---|
| 1,895,417 | A * | 1/1933 | Lard | 473/310 |
| 5,261,669 | A * | 11/1993 | Kochevar | 473/312 |
| 6,620,054 | B2 * | 9/2003 | Tseng | 473/306 |
| 6,855,067 | B2 * | 2/2005 | Solheim et al. | 473/310 |
| 7,083,529 | B2 * | 8/2006 | Cackett et al. | 473/309 |
| 7,704,158 | B2 * | 4/2010 | Burrows | 473/288 |
| 7,819,754 | B2 * | 10/2010 | Evans et al. | 473/307 |
| 7,883,430 | B2 * | 2/2011 | Thomas et al. | 473/307 |
| 7,892,107 | B2 * | 2/2011 | Vald'Via et al. | 473/309 |
| 8,029,383 | B2 * | 10/2011 | Yamamoto | 473/307 |
| 2002/0037773 | A1 * | 3/2002 | Wood et al. | 473/246 |
| 2003/0228929 | A1 * | 12/2003 | Miyasu et al. | 473/300 |
| 2004/0018887 | A1 * | 1/2004 | Burrows | 473/307 |
| 2011/0092308 | A1 * | 4/2011 | Thomas et al. | 473/307 |

FOREIGN PATENT DOCUMENTS

JP 11-178954 A 7/1999

* cited by examiner

*Primary Examiner* — Stephen L. Blau
(74) *Attorney, Agent, or Firm* — Sughrue Mion, PLLC

(57) ABSTRACT

According to one aspect of the invention, a golf club includes: a head having a hosel having a hosel hole; a shaft; a shaft case having a shaft insertion hole to which one end of the shaft is inserted and configured to be inserted to the hosel hole; and a ring-shaped screw member configured to be screwed into one end of the hosel to fix the shaft case in the hosel hole, and to be fitted with an outer face of an one end of the shaft case so as not to contact with the shaft directly, wherein an axis of the shaft insertion hole is nonparallel to an axis of the hosel hole, and an inner face of the hosel hole and an outer face of the shaft case includes a triangular or more polygonal cross-sectional face that is perpendicular to the axis of the hosel hole.

6 Claims, 10 Drawing Sheets

4
5a
6e
5g
6a
6e
5t
6
6b
5a
5
5c
5c
3H
5b
3a
1
3b
3

GOLF CLUB AND METHOD FOR ADJUSTING PROPERTIES THEREOF

BACKGROUND

1. Field

The present invention relates to a golf club and more particularly to a golf club which facilitates the replacement of shafts. In addition, the invention relates to a method for adjusting the properties of the golf club.

2. Description of the Related Art

A golf club is such that a club head is attached to a distal end portion of a shaft. A grip is attached to a proximal end of the shaft.

In a conventional golf club head, a hosel hole is provided directly in the head, and a shaft is inserted into the hosel hole and is then secured in place therein with an adhesive. In addition, in general, an epoxy-based adhesive is used for the adhesive. In replacing shafts, the hosel portion is heated to break the texture of a cured epoxy resin substance to thereby pull the shaft out of the hosel hole.

JP-A-11-178954 describes a golf club head in which a head main body and a hosel are provided separately and the hosel is fixed to the head main body with a screw. In JP-A-11-178954, a plate-shaped neck portion is provided on a lower end side of the hosel, and this neck portion is inserted into an inserting and attaching portion of the head main body, so as to be fixed in place therein with the screw. By the plate-shape neck portion being fixed to the head main body in the way described above, suppleness is made to be generated in the neck portion on impact when a ball is hit by the club head, so as to mitigate stress concentration generated in a connecting portion between the shaft and the hosel.

In the golf club head described in JP-A-11-178954, the connecting strength and rigidity between the head main body and the hosel become insufficient, and hence, a sensation of strong impact cannot be obtained. In addition, the hosel position becomes excessively high. Additionally, the lie angle and slice angle of the golf club cannot be adjusted.

SUMMARY OF THE INVENTION

In the golf club and the method for adjusting the properties thereof according to the invention, by the screw member being loosened to be removed, the shaft case can be pulled out of the hosel hole. Then, this shaft case is rotated slightly so as to change its orientation and is thereafter inserted back into the hosel hole, and the screw member is screwed back. In this shaft case, since the axis of the shaft insertion hole is made oblique relative to the axis of the hosel hole (for example, in a direction in which the former axis intersects obliquely the latter axis), in the event that the orientation of the shaft case is changed in this way, the attaching direction of the shaft to the head of the golf club is changed, whereby the lie angle and slice angle of the golf club are changed.

Consequently, only the lie angle and slice angle can be adjusted in the golf club without replacing shafts and club heads.

In addition, a shaft case which is completely the same in type as the shaft case is prepared separately, and a shaft having different properties is secured to the shaft case so prepared, so as to prepare a shaft case and shaft connected unit. Then, the existing shaft case and shaft connected unit which is attached to the club head is detached therefrom for replacement with the shaft case and shaft connected unit prepared in the way described above, and the prepared shaft case and shaft connected unit is then attached to the club head, thereby making it possible to obtain a golf club which differs only in the type of shaft from the existing golf club. Additionally, a configuration may be adopted in which a shaft case having a shaft insertion hole inclined at a different angle is used as the shaft case, while a shaft having the same properties as those of the existing shaft is used. As to the shaft, a shaft having different properties may be used.

In recent years, in order to help a golfer find a golf club which matches his or her own level of technique, there have been developed systems with which the golfer can find a golf club which matches him or her by the use of a computer and a high-speed camera. These systems are such that the golfer test hits balls with marketed golf clubs for comparison based on head speed, hitting angle and the like so as to find a golf club which matches him or her.

In contrast to this, according to the golf club of the invention, the golfer can actually feel the difference between different shafts only by attaching the different shafts to the same club head or can actually feel in an easy fashion the difference in ball-flight properties of balls hit by changing the distance to the center of gravity or progression by changing the positional relationship between the same shaft and club head. In addition, depending upon the conditions of the golf player, shafts can be replaced, or the attaching angle of the shaft to the club head can also be changed in order to adjust the lie angle and/or slice angle while the shaft remains the same.

In the gold club and method for replacing shafts thereof according to the invention, when the screw member is loosened to be removed from the shaft case, the shaft case can be pulled out of the hosel hole. Then, a new shaft case and shaft connected unit in which a shaft is attached to a shaft case in advance is prepared, and the shaft case and shaft connected unit so prepared is inserted into the hosel hole. Then, the screw member is screwed back on to the new shaft case so inserted, whereby the shafts can be replaced.

According to the method for replacing shafts of the invention, the complicated labor work and hours can be eliminated which were conventionally required to break the texture of the adhesive by heating for removal of the shaft and attaching a new shaft with the adhesive again. Because of this, since the shaft can be removed from the head of the golf club which has just been tested so that a different shaft having different properties can be attached to the club head without any delay for another test hitting, this enables a golfer to find very easily a golf club suitable for him or her from golf clubs on sale at a shop. In addition, the evaluation of shafts can be implemented without considering the difference in production quality between individual club heads. Further, the lie angle and slice angle of the golf club can be changed easily while the club head and the shaft remain the same.

In the invention, since the shaft case is inserted into the hose hole and the shaft case is fixed by the screw member, the shaft case is attached to the hosel strongly and rigidly.

In the invention, the screw member is disposed on the outer circumference of the shaft case in such a manner as not to be in contact with the shaft, even though the screw member is rotated, there is no such situation that the screw member scratches the shaft, whereby the shaft can be prevented from being damaged by the screw member.

In the golf club of the second aspect of the invention, when the screw member is screwed into the upper end side of the hosel, the lower end of the screw member presses against the projecting portion on the shaft case, whereby the shaft case is fixed in place.

According to the third aspect of the invention, looseness between the screw member and the projecting portion can be prevented.

In the golf club of the fourth aspect of the invention, the shaft can be inserted into the shaft insertion hole so as to be bonded strongly and rigidly in place therein.

According to the golf club of the fifth aspect of the invention, the circumferential positioning (phasing) of the shaft case is implemented. In addition, the rotation between the club head and the shaft case is prevented.

According to the golf club of the sixth aspect of the invention, impact or vibration between the shaft case and the inner surface of the hosel is absorbed.

According to an aspect of the present invention, there is provided a golf club including: a head having a hosel having a hosel hole; a shaft; a shaft case having a shaft insertion hole to which one end of the shaft is inserted and configured to be inserted to the hosel hole; and a ring-shaped screw member configured to be screwed into one end of the hosel to fix the shaft case in the hosel hole, and to be fitted with an outer face of an one end of the shaft case so as not to contact with the shaft directly, wherein an axis of the shaft insertion hole is nonparallel to an axis of the hosel hole, and an inner face of the hosel hole and an outer face of the shaft case includes a triangular or more polygonal cross-sectional face that is perpendicular to the axis of the hosel hole.

According to another aspect of the present invention, there is provided a method for adjusting a properties of a golf club having a head having a hosel having a hosel hole; a shaft; a shaft case having a shaft insertion hole to which one end of the shaft is inserted and configured to be inserted to the hosel hole; and a ring-shaped screw member configured to be screwed into one end of the hosel to fix the shaft case in the hosel hole, and to be fitted with an outer face of an one end of the shaft case so as not to contact with the shaft directly, wherein an axis of the shaft insertion hole is nonparallel to an axis of the hosel hole, and an inner face of the hosel hole and an outer face of the shaft case includes a triangular or more polygonal cross-sectional face that is perpendicular to the axis of the hosel hole when the shaft case is inserted to the hosel hole, the method including: removing the screw member from the hosel by rotating the screw member round the axis of the hosel hole; rotating the shaft and the shaft case round the axis of the hosel hole to change an orientation of the shaft with respect to the golf club head; and screwing the screw member back into the hosel hole to fix the shaft case in the hosel hole.

DETAILED DESCRIPTION

Figure 1:
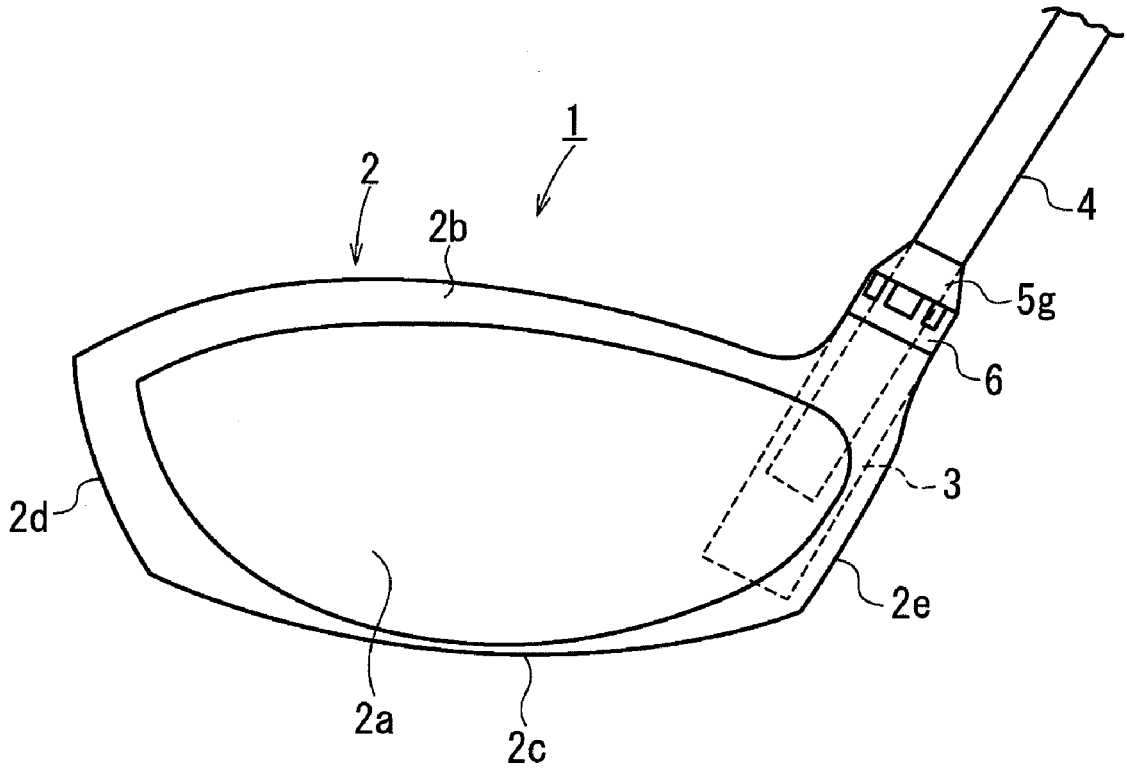
FIG. 1 is a front view of a head according to an embodiment.
Figure 2:
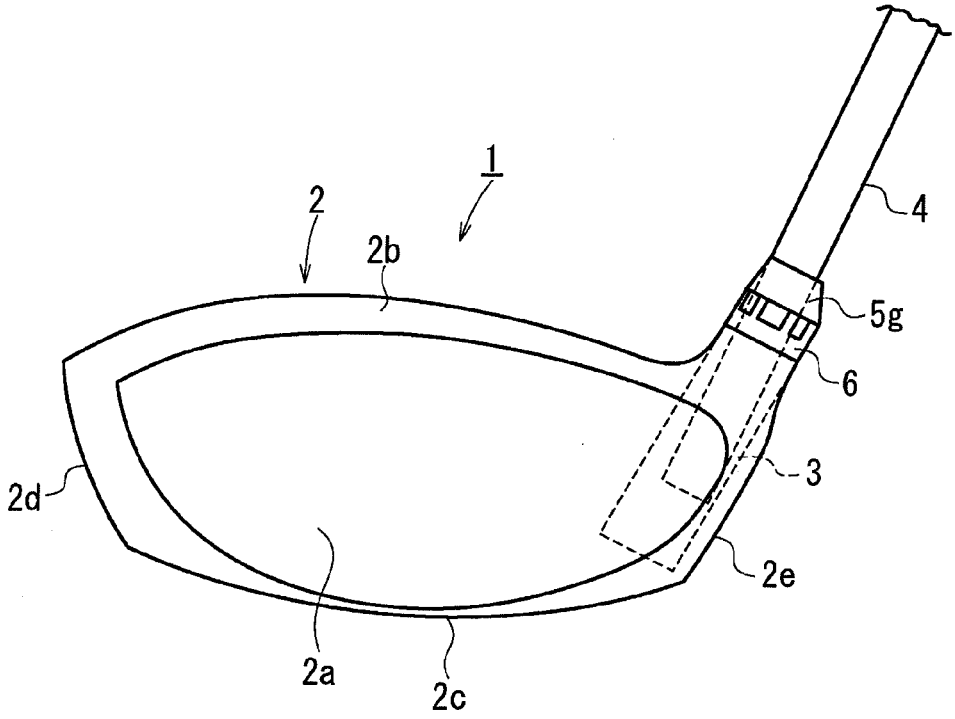
FIG. 2 is a front view of the head with the orientation of a shaft changed.
Figure 3:
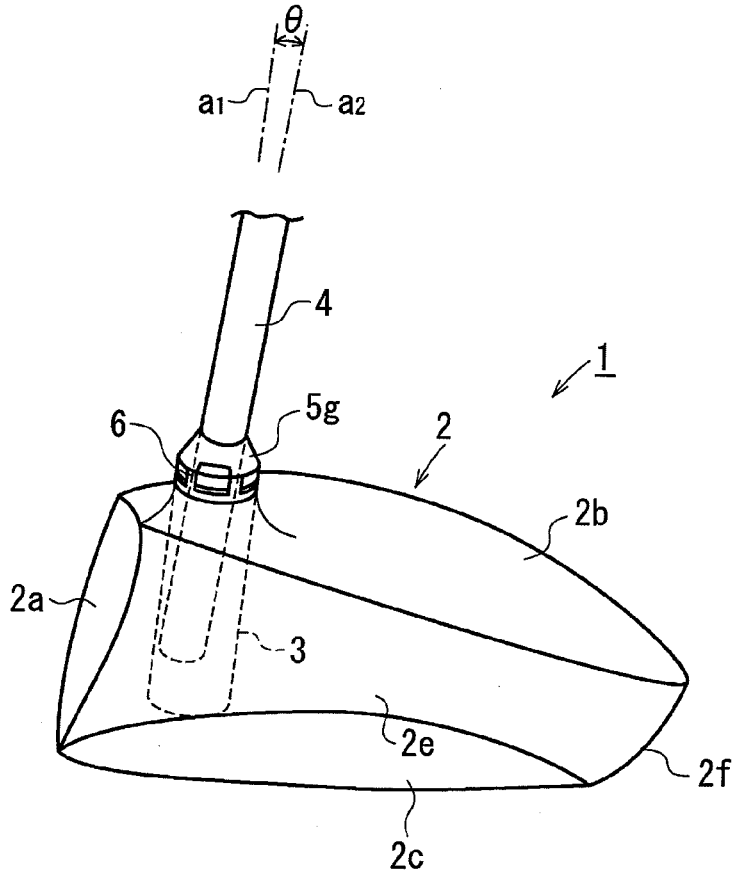
FIG. 3 is a side view of the head with the orientation of the shaft changed.
Figure 4:
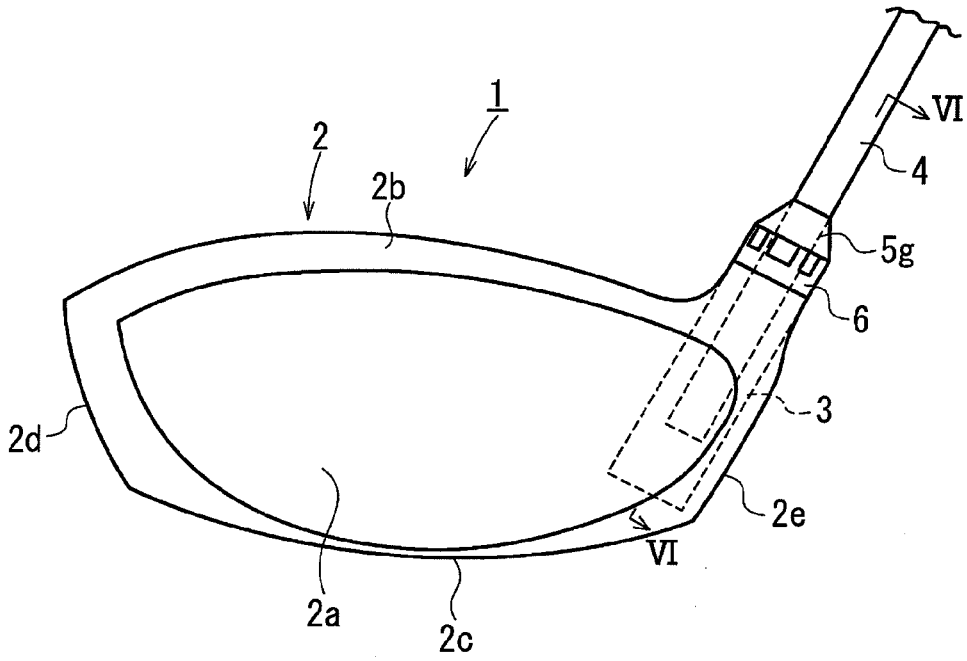
FIG. 4 is a front view of the head with the orientation of the shaft changed.
Figure 5:
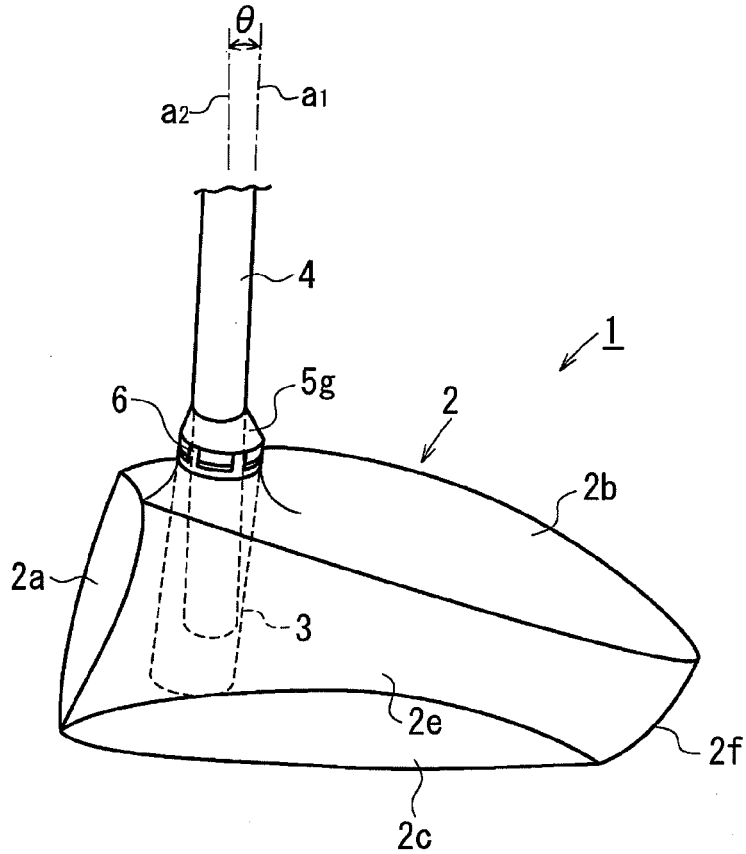
FIG. 5 is a side view of the head with the orientation of a shaft case changed.
Figure 6:
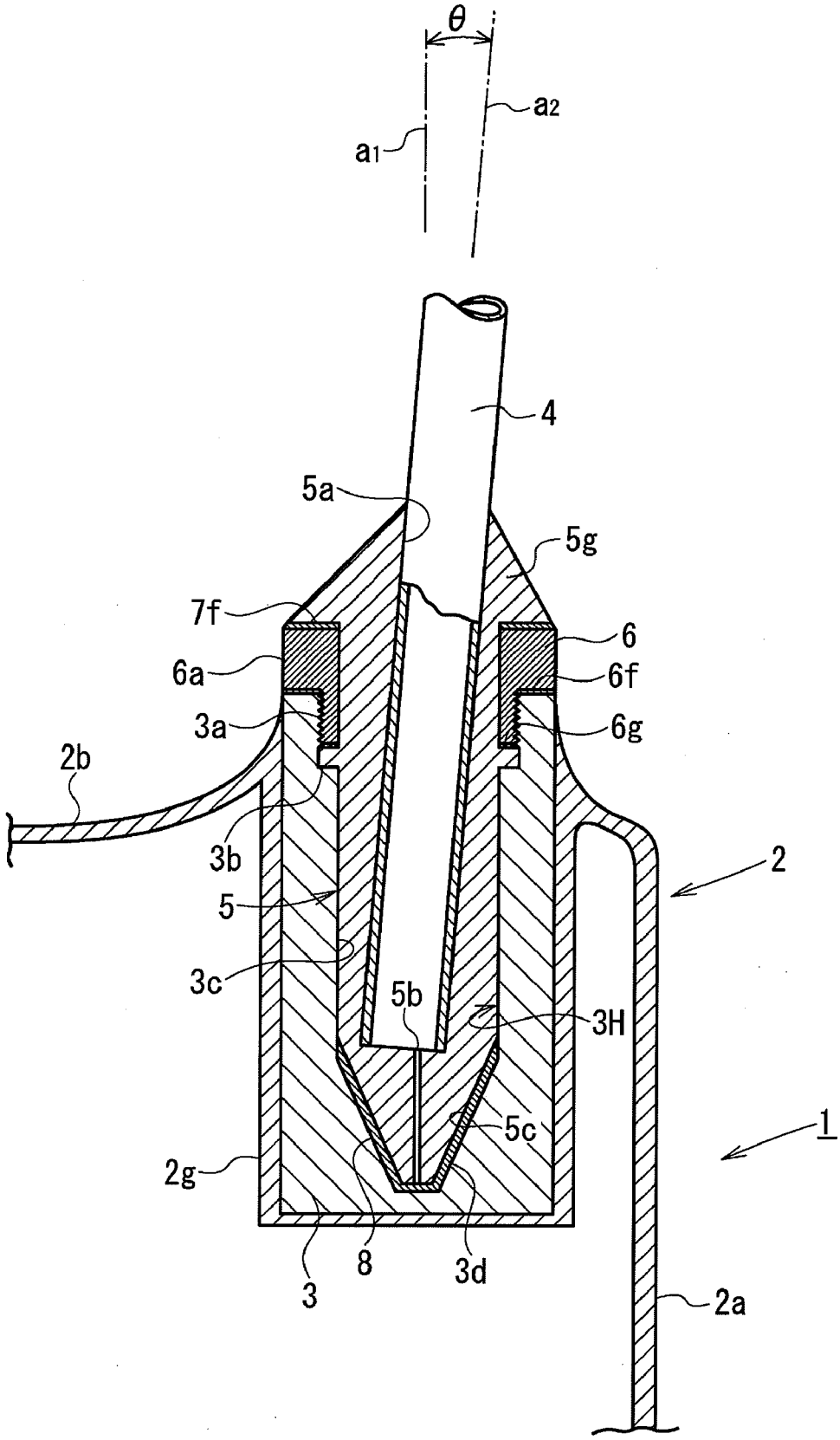
FIG. 6 is a sectional view taken along the line VI-VI in FIG. 4.
Figure 7:
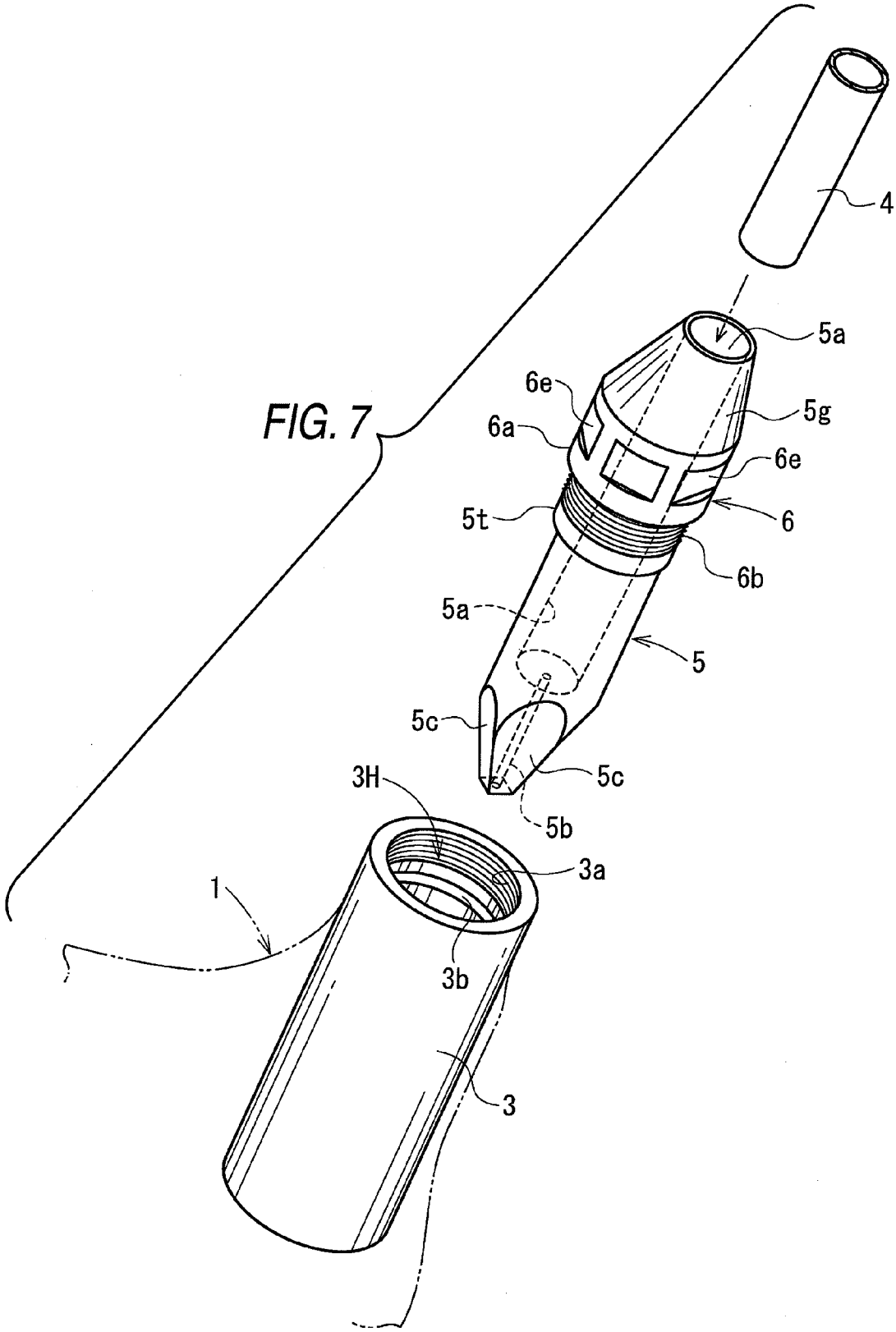
FIG. 7 is a perspective view of a hosel, the shaft case and a screw member.

Hereinafter, referring to the drawings, embodiments of the invention will be described. FIG. 1 is a front view of a golf club head according to an embodiment of the invention, FIG. 2 is a front view of a golf club which results when a shaft case is rotated through 180° from the state shown in FIG. 1 and is then reattached, and FIGS. 3 and 4 are front views of the golf club which result when the shaft case is rotated through 90° forwards and backwards, respectively, from the state shown in FIG. 2 and is then reattached. FIG. 5 is a side view of a heal side of the golf club head shown in FIG. 4. FIG. 6 is a sectional view taken along the line VI-VI in FIG. 4, and FIG. 7 shows perspective views of the shaft case, a screw member and a shaft distal end portion.

This golf club is such that a shaft 4 is attached to a hosel 3 of a head 1 via a shaft case 5 and a screw member 6.

This head 1 has a head main body 2 and the hosel 3 attached to the head main body 2. This head is of a hollow wood type and has a face portion 2*a*, a crown portion 2*b*, a sole portion 2*c*, a toe portion 2*d*, a heal portion 2*e* and a back portion 2*f*.

As is shown in FIG. 6, a cylindrical hosel installation portion 2*g* is provided on a face portion 2*a* side and a heal portion 2*e* side of the crown portion 2*b*. This hosel installation portion 2*g* has a cylindrical shape which is opened at an upper end and is closed at a lower end thereof and extends in a direction in which the shaft case 5 is inserted. The hosel 3 is inserted into an interior of the hosel installation portion 2*g* from thereabove and is secured in place therein by an appropriate securing means such as welding, brazing, shrink fit and cooling fit. However, the hosel may be provided integrally with the head main body. For example, a hosel may be prepared integrally with a head main body through casting and be made to be worked by a CNC working machine with a view to enhancing the dimension accuracy.

As is shown in FIGS. 6, 7, the hosel 3 has a substantially cylindrical shape in which a hosel hole 3H is opened in an axial direction from an upper end to a lower end. An upper portion of an inner circumferential surface of the hosel hole 3H has a cylindrical shape, while a lower portion thereof has a regular quadrangular pyramid shape (precisely speaking, a truncated regular quadrangular pyramid shape) whose diameter is reduced towards a lower end of the hosel hole 3H. However, as will be described later, the lower portion of the inner circumferential surface of the hosel hole 3H may be formed into any regular polygonal pyramid shape including a regular triangular pyramid shape, a regular hexagonal pyramid shape, and a regular octagonal pyramid shape.

A female thread 3*a* is provided on the inner circumferential surface of the hosel hole 3H at an entrance side, that is, at an upper end side of the hosel. In this embodiment, the screw member 6, which will be described later, is screwed into this female thread 3*a*.

A stepped surface 3*b* is provided in a diameter-reducing direction in such a manner as to follow the female thread 3*a*, and a portion lying deeper than this stepped surface 3*a* is made into a cylindrical portion 3*c*. A portion of the inner circumferential surface which lies deeper than the cylindrical portion 3*c* is made into a regular quadrangular pyramid shape whose diametrical distance gradually reduces at it extends deeper, and a four inclined surfaces 3*d* are provided in such a manner as to intersect obliquely an axis of the hosel 3. An angle at which one of a pair of confronting inclined surfaces 3*d* is inclined relative to the other or vice versa or an angle of intersection (an included angle) ranges from 10 to 30° and preferably ranges approximately from 15 to 20°.

The shaft case 5 is a cylindrical member whose diameter is slightly smaller than the cylindrical portion 3*c* of the hosel 3, and a shaft insertion hole 5*a* into which the shaft 4 is to be inserted is provided in such a manner as to extend from an upper end side towards a lower end side thereof. An outer circumferential surface of the shaft case 5 is formed into a cylindrical shape excluding a lower portion thereof. An inner circumferential surface of the shaft insertion hole 5*a* is also formed into a cylindrical shape excluding a lower portion thereof.

In this embodiment, an axis $a_2$ of the shaft insertion hole 5*a* is made to intersect obliquely an axis $a_1$ of the outer circumferential surface of the shaft case 5. An angle of intersection θ of the axes $a_1$, $a_2$ (FIG. 6) ranges from 0.1 to 5.0° and preferably ranges approximately from 0.25 to 3.0°.

In addition, the axes $a_1$, $a_2$ do not have to intersect each other but may be in a "twisted" relationship. Namely, the axes $a_1$, $a_2$ do not intersect each other but may be in a relationship in which the axis $a_2$ passes in the vicinity of the axis $a_1$. As this occurs, with respect to angles of the axes $a_1$, $a_2$, with the axis $a_2$ inclined most towards the heel side and a plane assumed which includes the axis a1 and extends in the direction of a ball-flight line, an angle of intersection between this plane and the axis $a_2$ may only have to be made to fall within the range of the angle of intersection θ.

An outside diameter of the shaft case 5 ranges from 12 to 20 mm and preferably ranges approximately from 13 to 15 mm, and an inside diameter of the shaft insertion hole 5*a* ranges 8 to 10 mm and preferably ranges approximately from 8.5 to 9.0 mm. An outside diameter of the hosel 3 ranges from 13 to 20 mm and preferably ranges approximately from 15 to 19 mm.

A small air relief hole 5*b* is opened in such a manner as to extend from a deep bottom surface of the shaft insertion hole 5*a* to a lower end face of the shaft case 5.

A projecting portion 5*t* is provided on the outer circumferential surface of the shaft case 5 in a position lying half way up or down along the axis (length) thereof. In this embodiment, the projecting portion 5*t* is a flange which surrounds circumferentially the shaft case 5. This projecting portion 5*t* has a diameter which allows the projecting portion 5*t* to be brought into the stepped surface 3*b* from thereabove.

A lower end side of the outer circumferential surface of the shaft case 5 is made into a quadrangular pyramid shape (precisely speaking, a truncated quadrangular pyramid shape) whose diametrical distance gradually reduces as it extends towards a lower end thereof, and four inclined surfaces 5*c* are provided. The inclined surfaces 5*c* are provided symmetrically with respect to the axis of the shaft case 5. An angle of intersection between a pair of confronting inclined surfaces 5*c*, 5*c* is the same as the angle of intersection between the confronting inclined surfaces 3*d* of the hosel 3. The size of the inclined surface 5*c* may be made identical to that of the inclined surface 3*d* of the hosel 3, and when an elastic element is interposed therebetween, the inclined surface 5*c* of the shaft case 5 may be made slightly smaller than the inclined surface 3*d* of the hosel 3.

A diametrically extended portion 5*g*, which has a tapered outer circumferential surface whose diameter is made to be reduced as it extends towards an upper end, is provided at an upper end of the shaft case 5. This diametrically extended portion 5*g* is formed into an eccentric frustum of circular cone shape, and the shaft insertion hole 5*a* is made to open to an upper surface thereof. A lower surface of the diametrically extended portion 5*g* is superimposed on an upper surface of the screw member 6 via a spacer 7*f* (refer to FIG. 6).

A portion which follows a lower side of the diametrically extended portion 5*g* of the shaft case 5 is made into a small diameter portion 5*h* (FIG. 6). The screw member 6 fits rotatably on the small diameter portion 5*h*. The projecting portion 5*t* is provided further downwards than the small diameter portion 5*h* on the shaft case 5. A lower end face of the screw member 6 is brought into abutment with the projecting portion 5*t* via a spacer 6*g*.

In addition, although illustration is omitted, a chamfer of the order of 20 to 45° may be formed at an inner circumferential edge at an upper end side of the shaft insertion hole 5*a* so as to facilitate the insertion of the shaft 4 into the shaft insertion hole 5*a*.

The screw member 6 has a substantially annular shape, and a lower half portion is made diametrically smaller than an upper half portion, a male thread 6*b* (FIG. 7) being cut on an outer circumferential surface of the lower half portion. As is shown in FIG. 7, six flat surface portions 6*e* are provided on an outer circumferential surface of an upper end side of the upper half portion 6*a*, which makes the upper half portion into a nut-like configuration. A tool such as a monkey wrench or a spanner can be placed on the flat surface portions 6*e* to rotate the screw member 6.

In building up the golf club, as is shown in FIG. 7, a distal end of the shaft 4 is inserted into the shaft insertion hole 5*a* of the shaft case 5 and is secured in place therein by the use of an adhesive in advance. Preferably, the adhesive is applied to an outer circumferential surface of the distal end portion of the shaft 4, and the distal end of the shaft is then inserted as deep as a deepest portion in the shaft insertion hole 5*a*. An epoxy-based adhesive is preferable as the adhesive.

Since the small hole 5*b* is provided in the shaft case 5, air flows out through the small hole 5*b* when the shaft 4 is inserted into the shaft insertion hole 5*a*.

A shaft case and shaft connected unit in which the screw member 6 is attached and the shaft case 5 is secured in the way described above is inserted into the hosel hole 3H. In addition, in this embodiment, a thin, film-like elastic element 8 (for example, a thickness of the order of 0.5 to 5 mm) made of a rubber or elastomer is securely coated or affixed to the shaft case 5 in such a manner as to cover the inclined surfaces 5*c* of the shaft case 5 and a distal end face of the shaft case 5 in advance. The elastic element 8 may be provided on the shaft case 5 in advance or may be provided on the shaft case 5 after the shaft case and shaft connected unit has been configured.

A thin, film-like elastic element 6*g* made of a rubber or elastomer may be disposed between the screw member 6 and the stepped surface 3*b*.

A thin, film-like elastic element 6*f* made of a rubber or elastomer may be disposed between the screw member 6 and the hosel 3.

After the shaft case and shaft connected unit is inserted into the hosel hole 3H in such a manner that the inclined surfaces 5*c* and the inclined surfaces 3*d* are superimposed on each other, the male thread 6*b* of the screw member 6 is screwed into the female thread 3*a* on the upper inner circumferential surface of the hosel hole 3H.

By this action, as is shown in FIGS. 3 to 6, the lower end face of the screw member 6 presses against the projecting portion 5*t* of the shaft case 5, whereby the inclined surfaces 5*c* of the shaft case 5 are pressed against the inclined surfaces 3*d* of the hosel 3 via the elastic element 8, and the shaft case 5 is fixed to the hosel 3. Since the shaft case 5 and the shaft 4 are bonded together strongly and rigidly by the adhesive, this construction enables a golf club to be completed in which the shaft 4 and the head 1 are made integral.

Note that in FIGS. 4 to 6, the shaft 4 is in such a state that the shaft 4 is inclined most in the direction of ball-flight line, that is, towards the face portion 2*a* side. However, this inclined direction can be changed as will be described later by reference to FIGS. 1 and 2.

To pull the shaft case 5 out of the golf club, the screw member 6 is rotated in a loosening direction. Since the male thread 6*b* of the screw member 6 is in thread engagement with the female thread 3*a* of the hosel 3, when the screw member 6 is rotated in the loosening direction, the screw member 6 is caused to move (screw) upwards, whereby the diametrically extended portion 5*g* is pushed upwards by the screw member 6, and the shaft case 5 moves upwards. Since the shaft case 5 moves upwards in such a manner as to be removed from the hosel 3, the shaft case 5 can easily be removed from the golf club.

After having been removed from the hosel 3, the shaft case 5 is rotated through 90° or 180° so as to change the orientation thereof and is then inserted back into the hosel hole 3H again, and the screw member is screwed into the female thread 3*a*. The axis $a_2$ of the shaft insertion hole 5*a* is inclined by the angle θ relative to the axis $a_1$ of the hosel hole 3H. Because of this, by the shaft case 5 being rotated through 90° or 180°, the inclined direction of the shaft 4 can be changed. In FIG. 1, the shaft 4 is inclined most towards the heal side. In FIG. 2, the shaft 4 is inclined most towards the toe side. In FIG. 3, the shaft 4 is in such a state that the shaft 4 is inclined most towards the rear.

By changing the inclination of the shaft 4 in the way described above, the lie angle and slice angle of the golf club can be changed.

To describe with respect to the lie angle, the lie angle is the smallest in FIG. 1, constituting a flat lie, while the lie angle is the largest in FIG. 2, constituting an up lie. The lie angle is shown as staying middle between the flat lie and the up lie in FIGS. 3 to 6.

To describe with respect to the slice angle, in FIGS. 4 to 6, a hook face is shown in which the club face is most closed, constituting a hook face, while in FIG. 3, the club face is most opened, constituting a slice face, and FIGS. 1 and 2 show an intermediate face position between the hook face and the slice face.

In this way, according to the embodiment, the inclined angle of the shaft 4 relative to the head 1 can be changed, whereby the lie angle and slice angle can be changed.

In this embodiment, while the diametrically extended portion 5*g* has the tapered shape, a configuration may be adopted in which a flat flange-shaped diametrically extended portion is provided and a ferrule is attached to an upper side of the diametrically extended portion.

In this embodiment, the screw member 6 is made to fit on the shaft case 5 in such a manner as to be screwed into the hosel 3, and hence, the screw member 6 is not brought into contact with the shaft 4 when is rotated. Because of this, the shaft 4 is prevented from being damaged.

Since the film-like elastic element 8 made up of an elastomer or synthetic resin is interposed between the inclined surfaces 3*d* of the hosel 3 and the inclined surface 5*c* of the shaft case 5, impact and/or vibration produced when a ball is hit by the golf club can be absorbed.

In this embodiment, since the inner circumferential surface of the hosel hole 3H at the deeper side thereof and the outer circumferential surface of the shaft case 5 at the lower end side thereof are both made into the quadrangular pyramid shapes by providing the inclined surfaces 3*d*, 5*c* and these inclined surfaces 3*d*, 5*c* are brought into engagement with each other, little looseness is produced, and the shaft 4 is prevented from rotating in the circumferential direction about the axis of the shaft 4. Namely, the fixing rigidity in a torque direction of the shaft 4 is high.

In addition, since the four inclined surfaces 5*c* are provided and the shaft case 5 is tapered towards the distal end side thereof, the insertion of the shaft case 5 into the hosel 3 is facilitated.

In replacing shafts of the golf club, a shaft case which is of the same type as the shaft case 5 is secured in advance to a new shaft which is to replace the old shaft 4 with an adhesive. Additionally, a screw member 6 is also attached to the shaft.

The screw member 6 of the existing golf club is rotated and the old shaft 4 is removed from the head 1 together with the old shaft case 5 and the screw member 6. Next, the new shaft with the shaft case and the screw member attached thereto (the shaft case and shaft connected unit) is inserted into the hosel hole 3H in the head 1 and is then fixed in place there in by the screw member 6 being screwed into the female thread 3*a*.

In this way, the attachment or replacement of shafts can be implemented extremely simply and quickly. Although in the conventional construction, the replacement of shafts took a time ranging approximately from several hours to a day due to the procedure inherent therein which involves the steps of heating the hosel portion of the existing golf club to break the texture of the cured adhesive substance, removing the existing shaft and thereafter securing a new shaft with an adhesive, in the embodiment that has been described heretofore, by the shaft case 5 being attached to the new shaft with the adhesive in advance, the replacement of shafts can be implemented within such a short period of time of the order of several minutes. Consequently, a method for utilizing the golf club of the embodiment can be realized in which shafts of various specifications each paired with a shaft case are prepared so that the shafts so prepared can sequentially be attached to the same head main body for test hitting.

In addition, a configuration may be adopted in which shaft cases 5 having shaft insertion holes 5*a* whose inclined angles θ differ from each other are produced in advance, and shafts are secured individually to the shaft cases so prepared to produce replacement shaft case and shaft connected units. By the existing shaft case and shaft connected unit being replaced by these replacement shaft case and shaft connected units, the lie angle and slice angle can be changed.

For example, a group of shaft cases of different types are prepared as replacement shaft cases in advance in which the aforesaid angle θ is changed in small steps of 0.5°, 1°, 1.5°, 2°, 2.5° and 3°, so as to change the lie angle and slice angle in corresponding small steps for test hitting.

In this embodiment, as is shown in FIGS. 6, 7, the upper end of the shaft insertion hole 5*a* is eccentrically offset from the center of the upper end of the shaft case 5. Because of this, the golfer can get to know the orientation of the shaft case 5 based on the position of the upper end of the shaft insertion hole 5*a* and also get to know in which direction the shaft 4 is inclined from the orientation of the shaft case 5. In addition, compared with a construction shown in FIG. 8, which will be described later, the axis of the shaft 4 can be inclined largely, so as to change the lie angle and slice angle largely.

However, the upper end of the shaft insertion hole 5*a* may be disposed at the center of the upper end of the shaft case 5. As this occurs, the tapered surface of the diametrically extended portion 5 is formed into a regular conical shape, which improves the external appearance thereof.

Figure 8:
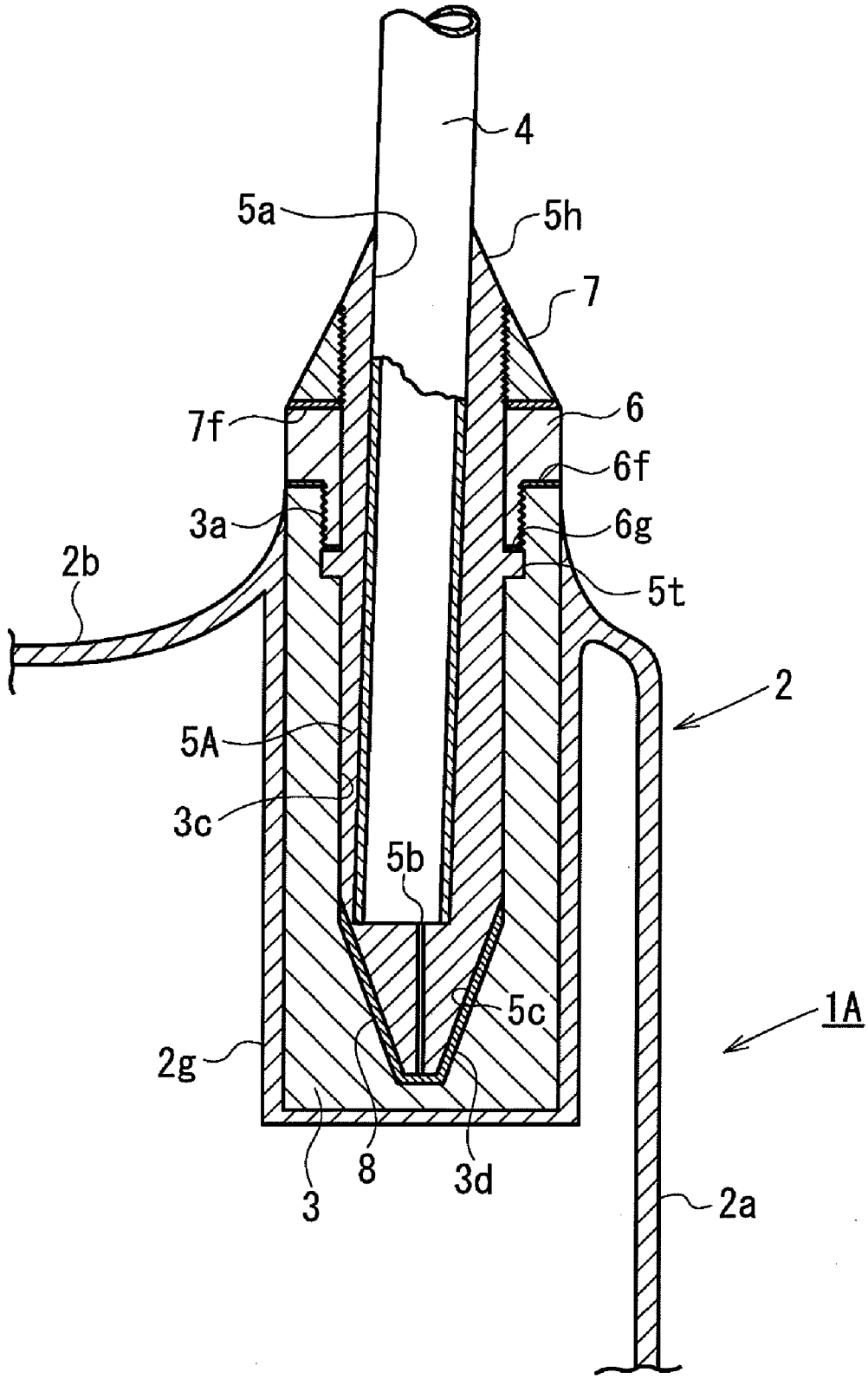
FIG. 8 is a sectional view showing the other embodiment.

The other embodiment of the invention will be described by reference to FIGS. 8 to 12. FIG. 8 is a sectional view of a portion of a golf club head according to the other embodiment which is similar to the portion of the golf club head shown in FIG. 3, FIGS. 9, 10A and 10B are perspective views which depict a method for attaching or replacing shafts, FIG. 11 shows perspective views of a hosel, a shaft case, a screw member and a top portion, and FIG. 12 shows sectional views of the hosel, the shaft case, the screw member and the top portion.

This golf club is such that a separate top portion 7 is attached to an upper end portion of a shaft case 5A which is secured to a hosel 3 of a head 1A.

Figure 11:
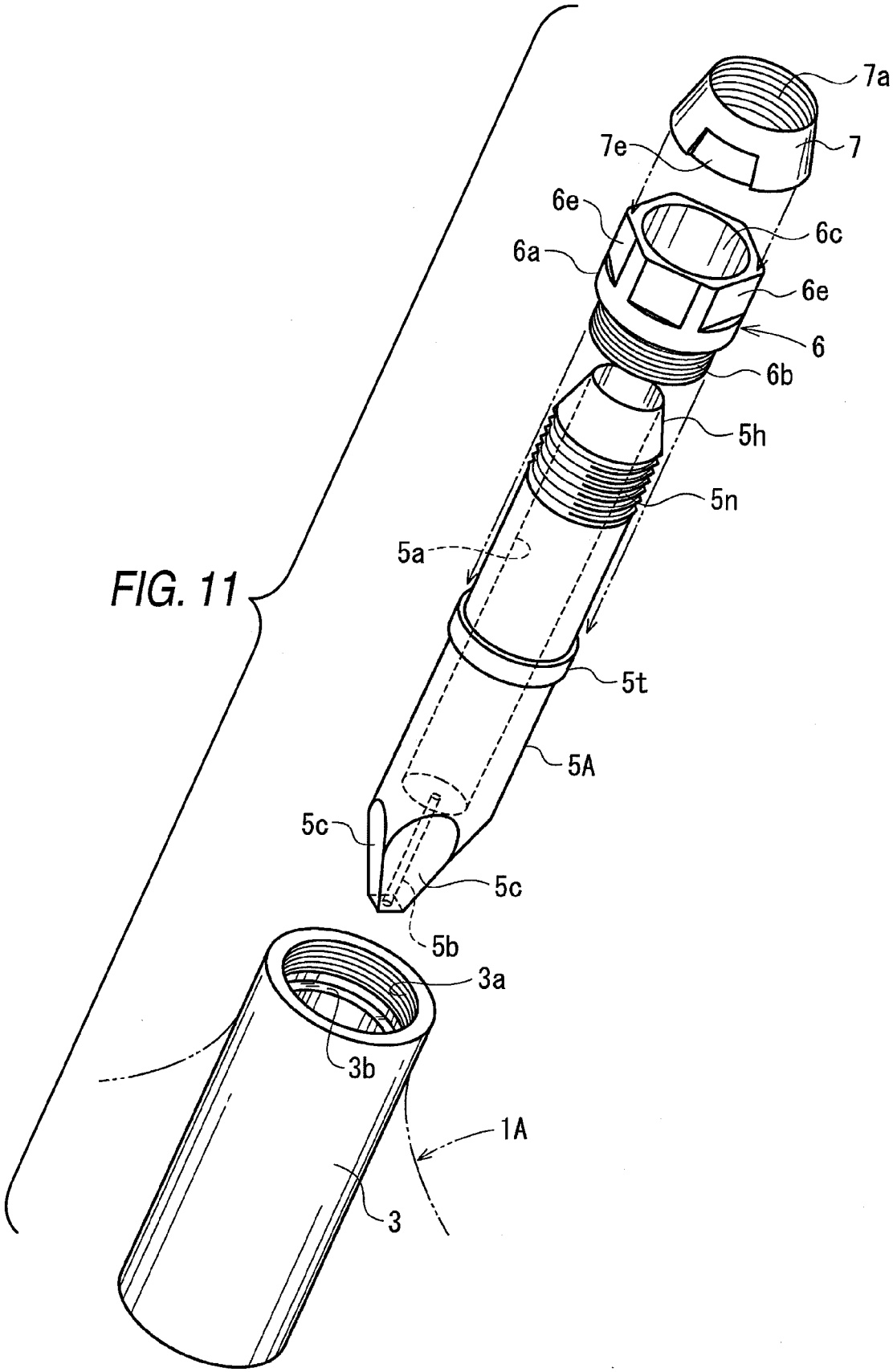
FIG. 11 is an exploded perspective view of the embodiment shown in FIG. 8.
Figure 12:
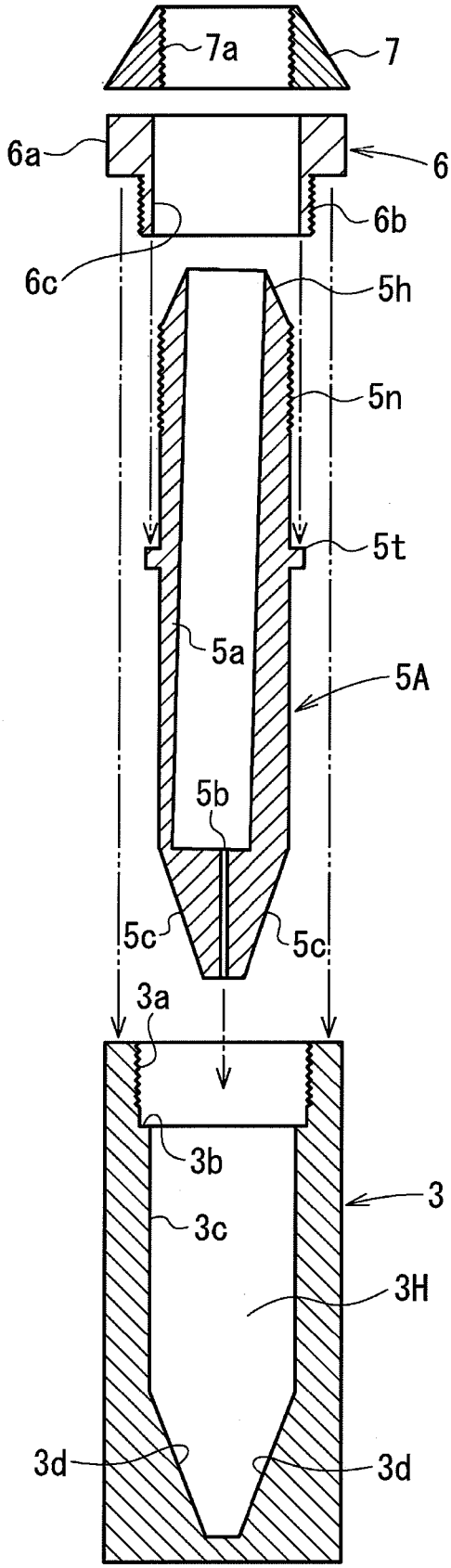
FIG. 12 is an exploded perspective view of the embodiment shown in FIG. 8.

As is shown in FIGS. 11, 12, the shaft case 5A is identical to the shaft case 5 of the previous embodiment in that the shaft case 5A is a cylindrical member whose diameter is made slightly smaller than a cylindrical portion 3*c* of the hosel 3, and a hole 5*a* into which the shaft 4 is to be inserted is provided from an upper end side towards a lower end side thereof.

An upper end of the shaft case 5A is formed into a tapered portion 5*h* which is diametrically reduced as it extends upwards. A male thread 5*n* is provided on an outer circumferential surface of an upper portion of the shaft case 5A which follows the tapered portion 5*h*. The top portion 7 is securely screwed on the male thread 5*n*.

The configurations of the hosel 3 and the screw member 6 are the same as those of the previous embodiment.

In this embodiment, the top portion 7 is provided upwards of the screw member 6. The top portion 7 is an annular element which has an outer circumferential surface whose diametrical distance is reduced as it extends upwards. A female thread 7*a* (FIG. 12) is provided on an inner circumferential surface of the top portion 7 in such a manner as to screw on the male thread 5*n* on the shaft case 5A. As is shown in FIG. 11, a pair of parallel surfaces 7*e* are provided at a lower end side of the outer circumferential surface of the top portion 7, whereby a tool can be brought into engagement with the parallel surfaces 7*e* so as to rotate the top portion 7. An elastic element of a rubber or elastomer, which is similar to that of the previous embodiment, or a thin spacer 7*f* made of a plastic or metal is interposed between the top portion 7 and the screw member 6. In addition, the top portion 7 may be fixed to the shaft case 5A by welding, bonding, clamping or the like.

The other configurations of this embodiment are the same as those of the previous embodiment, and like reference numerals are given to like portions to those of the previous embodiment.

Figure 9:
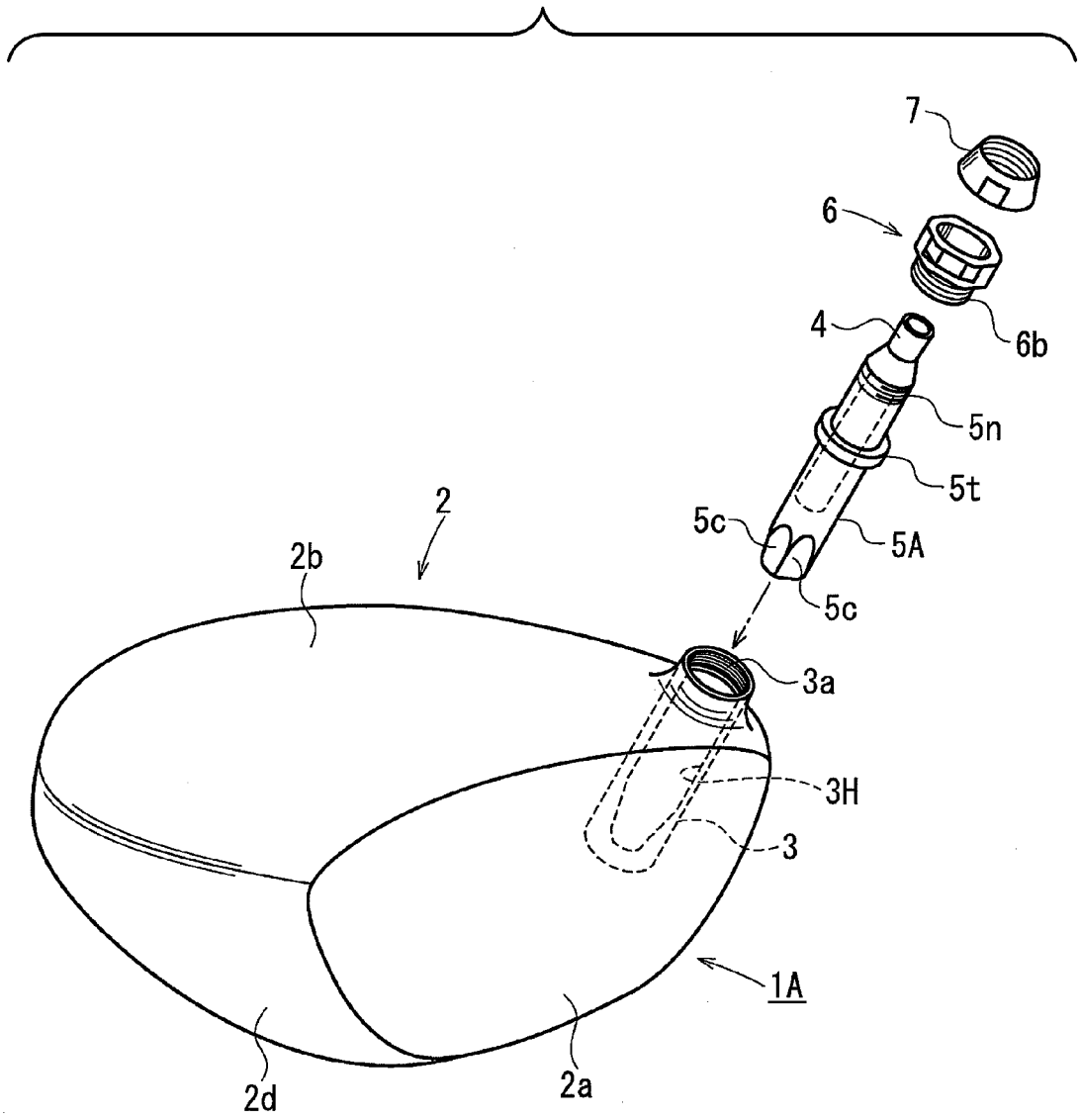
FIG. 9 is an exploded perspective view of the embodiment shown in FIG. 8.

In building up the golf club according to this embodiment, as is shown in FIG. 9, firstly, the top portion 7 and the screw member 6 are fittingly passed through the shaft 4 from an upper end side thereof, and the shaft case 5A is secured to a distal end of the shaft 4 by the use of an adhesive in advance. Preferably, the adhesive is applied to an outer circumferential surface of a distal end portion of the shaft 4, and then the shaft 4 is inserted as deep as a deepest portion in the hole 5*a* of the shaft case 5A.

Since a small hole 5*b* is provided in the shaft case 5A, air flows out through the small hole 5*b* when the shaft 4 is inserted into the hole 5*a* in the shaft case 5A. As the adhesive, an epoxy-based adhesive is preferred.

Figure 10A:
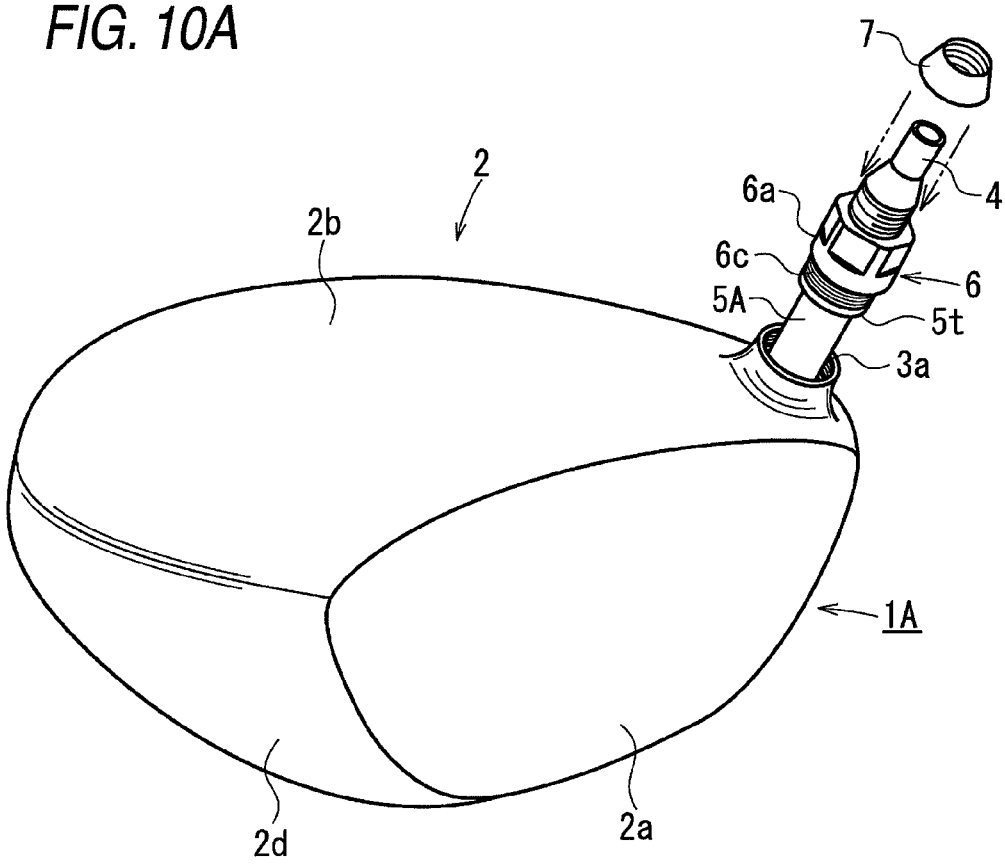
FIGS. 10A and 10B are exploded perspective views of the embodiment shown in FIG. 8.

The shaft case 5A of a shaft case and shaft connected unit in which the top portion 7 and the screw member 6 are fitted thereon and the shaft case 5A is secured in the way described above is inserted into the hosel 3 in the head 1A as is shown in FIGS. 9 and 10A.

Figure 10B:
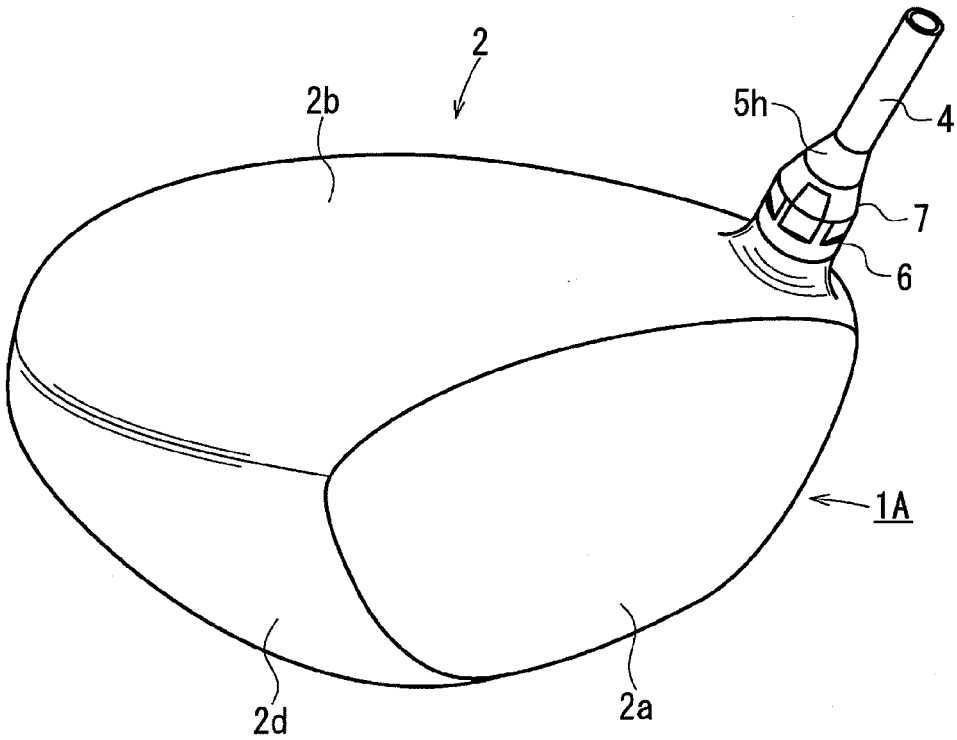

Following this, as is shown in FIG. 10B, the male thread 6*b* of the screw member 6 is screwed into the female thread 3*a* of the hosel 3, and following this, the top portion 7 is screwed on the male thread 5*a* of the shaft case 5A.

By this action, as is shown in FIG. 8, a lower end face of the screw member 6 presses against an upper end face of a projecting portion 5*t* of the shaft case 5A, and inclined surfaces 5*c* of the shaft case 5A are pressed against inclined surfaces 3*d* of the hosel 3 via the elastic element 8, whereby the shaft case 5A is fixed to the hosel 3. Since the shaft case 5A and the shaft 4 are bonded together strongly and rigidly by the adhesive, this construction enables a golf club to be completed in which the shaft 4 and the head 1A are made integral.

In order to pull the shaft case 5A out of the golf club, the screw member 6 is rotated in a loosening direction with the top portion 7 attached thereto. Since the male thread 6*b* of the screw member 6 is in thread engagement with the female thread 3*a* of the hosel 3, when the screw member 6 is rotated in the loosening direction, the screw member 6 is caused to move (screw) upwards so as to push up the top portion 7. Since the top portion 7 is secured to the shaft case 5A, when the top portion 7 is pushed upwards by the screw member 6, the top portion 7 and the shaft case 5A are caused to move upwards together, whereby since the shaft case 5A moves in an upward direction in which the shaft case 5A is removed from the hosel 3, the shaft case 5A can easily be removed from the golf club.

Also, in this embodiment, since an axis of the shaft insertion hole 5*a* is made to intersect obliquely an axis of the outer circumferential surface of the shaft case 5A, the inclined direction of the shaft 4 can be changed towards a heel side, a toe side, a direction of ball-flight line or a back side. By this configuration, a similar advantage to that of the previous embodiment is provided. In addition, in this embodiment, the upper end of the shaft insertion hole 5*a* is disposed in the center, whereby a tapered surface which is tapered at the same angle can be formed from the tapered surface of the top portion 7 to a tapered portion 5*h* of the shaft case 5A. Because of this, compared with the construction shown in FIG. 6, the golfer does not feel a sensation of physical disorder when he or she looks at the external appearance of the relevant portion of the golf club.

In addition, since the top portion is screwed on the male thread 5*a* of the shaft case 5A after the screw member 6 has been screwed into the female thread 3*a* of the hosel 3, the loosening of the screw member 6 is prevented.

The hosel, the shaft case and the screw member are preferably made of a metal and are preferably made of, in particular, aluminum, titanium or an alloy thereof. The hosel 3 is preferably made of a material whose specific weight is equal to or smaller than that of the head main body. For example, a titanium alloy, an aluminum alloy, a magnesium alloy, an FRP, a synthetic resin or the like may be used.

There is no specific limitation on the material of the head. However, in the case of a wood-type golf club head, for example, a titanium alloy, an aluminum alloy or a stainless steel can be used as the material of the head.

In the embodiments, while the four inclined surfaces 5*c*, 3*c* are provided for the shaft case and the hosel hole so that the shaft case and the hosel hole are each formed into the regular quadrangular pyramid shape, the shaft case and the hosel hole may be formed into a regular polygonal pyramid shape which has three or five or more inclined surfaces. In addition, the distal end side of the shaft case and the deep portion of the hosel hole may be formed into a shape having an indented polygonal cross section such as a star shape or a gear teeth-like cross section.

In addition, as a grip attached to the shaft 4, there is a case where a grip is used which has a cross section which is out of round. For example, there is a case where a lower surface of an outer circumferential surface of the grip which is directed to the ground when the golf club is in an address position is made to swell compared with the remaining surface. In this case, there may occur a situation in which the swelling portion of the grip is not positioned on the ground side when the orientation of the shaft case 5 is changed. Then, in the invention, it is preferred to use a grip having a round cross section.

In the embodiments, while the invention has been described as being applied to the wood-type golf club head, the invention can be applied to any type of golf club head including utility type and iron type golf club heads, as well as golf club heads of putters.

In addition, in the case of the hollow golf club head depicted in the accompanying drawings, because there are provided the hosel 3 and the hosel installation portion 2*g*, and the shaft case 5 or 5A and the screw member 6, the weight on the heel side becomes larger, when compared with golf clubs in general. Because of this, the golf club head may be attempted to be balanced in weight by increasing the thickness of the toe side or the back portion or providing a weight on the toe side.

As described with reference to the embodiment, there is provided a golf club in which a shaft with a shaft case can be fixed strongly and rigidly to a club head which is provided separately and which facilitates the detachable attachment of the shaft case to the club head, and a method for replacing shafts of the golf club.

In addition, there is provide a golf club which can adjust the properties of the golf club such as lie angle and slice angle, and a method for adjusting the properties of the golf club.

What is claimed is:

1. A golf club comprising:

a head having a hosel having a hosel hole;

a shaft;

a shaft case having a shaft insertion hole to which one end of the shaft is inserted and configured to be inserted to the hosel hole, the shaft case comprising an air relief hole extending from a bottom of the shaft insertion hole through the shaft case; and a ring-shaped screw member configured to be screwed into one end of the hosel to fix the shaft case in the hosel hole, and to be fitted with an outer face of an one end of the shaft case so as not to contact with the shaft directly, wherein an axis of the shaft insertion hole is nonparallel to an axis of the hosel hole, and an inner face of the hosel hole and an outer face of the shaft case includes a triangular or more polygonal cross-sectional face that is perpendicular to the axis of the hosel hole when the shaft case is inserted to the hosel hole;

wherein the other end of the shaft case is tapered into a portion having a polygonal section.

2. The golf club according to claim 1, wherein the shaft case includes a projecting portion on the outer face of a middle portion between the one end of the shaft case and the other end of the shaft case, the head includes a head main body and the hosel fixed to the head main body, one end of the hosel includes a female screw on an inner face of the hosel hole, the ring-shaped screw member includes a male screw on an outer face of the ring shaped screw member, the male screw being configured to be screwed on the female screw to fix the ring-shaped screw member to the hosel hole, and the shaft case is configured to be fixed to the hosel by the ring-shaped member in a state that the ring-shaped screw member contacts with the projecting portion.

3. The golf club according to claim 1, wherein an elastic member is provided on a lower side of the screw member.

4. The golf club according to claim 1, wherein the shaft is fixed to the shaft insertion hole by an adhesive.

5. The golf club according to claim 1, wherein an elastic element is disposed between the other end of the shaft case and the inner face of the hosel hole.

6. The golf club according to claim 1, further comprising a grip mounted on the other end of the shaft, wherein the grip includes a projecting portion extending in a longitudinal direction of the shaft.

* * * * *